US008725057B2

(12) United States Patent
Iino et al.

(10) Patent No.: US 8,725,057 B2
(45) Date of Patent: May 13, 2014

(54) IMAGE FORMATION APPARATUS

(75) Inventors: Hikaru Iino, Aichi (JP); Hiroyuki Okuchi, Aichi (JP); Masato Makino, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 193 days.

(21) Appl. No.: 13/074,273

(22) Filed: Mar. 29, 2011

(65) Prior Publication Data

US 2011/0280617 A1 Nov. 17, 2011

(30) Foreign Application Priority Data

May 12, 2010 (JP) ..... 2010-110485

(51) Int. Cl.

*G03G 15/00* (2006.01)
*G03G 15/16* (2006.01)
*G03G 21/16* (2006.01)

(52) U.S. Cl.

CPC ..... *G03G 15/6558* (2013.01); *G03G 15/165* (2013.01); *G03G 21/168* (2013.01); *G03G 2215/00409* (2013.01); *G03G 2215/0054* (2013.01)

USPC ..... 399/393; 399/121; 399/303

(58) Field of Classification Search

CPC ..... G03G 15/165; G03G 15/6558; G03G 21/168; G03G 2215/00409; G03G 2215/0054

USPC ..... 399/303, 388, 393

See application file for complete search history.

(56) References Cited

U.S. PATENT DOCUMENTS

| | | | |
|---|---|---|---|
| 7,965,957 | B2 | 6/2011 | Kubota et al. |
| 8,126,361 | B2 | 2/2012 | Nakano |
| 2004/0091283 | A1 | 5/2004 | Nobe et al. |
| 2006/0067734 | A1 | 3/2006 | Igarashi et al. |
| 2007/0048006 | A1 | 3/2007 | Igarashi et al. |
| 2007/0048010 | A1 | 3/2007 | Nakano |
| 2008/0187358 | A1 | 8/2008 | Kubota et al. |

(Continued)

FOREIGN PATENT DOCUMENTS

| | | | |
|---|---|---|---|
| CN | 1920693 | A | 2/2007 |
| CN | 101236391 | A | 8/2008 |

(Continued)

OTHER PUBLICATIONS

CN Office Action mailed Jun. 20, 2013, CN Appln. No. 201110090006.9, English Translation.

*Primary Examiner* — Benjamin Schmitt
(74) *Attorney, Agent, or Firm* — Banner & Witcoff, Ltd.

(57) ABSTRACT

An image formation apparatus has a belt unit and a drawer casing configured to accommodate the plurality of process units. The drawer casing is movable in a horizontal direction so that it is insertable in and/or drawable from a main body of the image formation apparatus. An openable cover for an opening formed on an end face of the drawer casing is provided. The drawer casing is arranged above an imaginary plane including the bridging surface of an endless belt, while a sheet tray is arranged below the imaginary plane. A pair of rollers is arranged on the sheet tray side with respect to the movable path and configured to feed the sheet fed from the sheet tray to the belt unit. A first guide and a second guide, which is provided opposite to the first guide with a predetermined clearance therebetween, are provided to form a sheet feed path.

14 Claims, 8 Drawing Sheets

(56) References Cited

U.S. PATENT DOCUMENTS

| | | | | |
|---|---|---|---|---|
| 2009/0166966 | A1* | 7/2009 | Nishikata et al. | 271/272 |
| 2009/0190978 | A1* | 7/2009 | Ikezaki | 399/395 |
| 2009/0194935 | A1 | 8/2009 | Wakakusa et al. | |
| 2009/0196652 | A1 | 8/2009 | Sakuma | |
| 2009/0285593 | A1 | 11/2009 | Sakuma | |

FOREIGN PATENT DOCUMENTS

| | | | |
|---|---|---|---|
| CN | 101271293 | A | 9/2008 |
| JP | 2001-341890 | | 12/2001 |
| JP | 2004-154974 | | 6/2004 |
| JP | 2006-098776 | | 4/2006 |
| JP | 2007-055774 | | 3/2007 |
| JP | 2007-086628 | | 4/2007 |
| JP | 2008-152305 | | 7/2008 |
| JP | 2009-180790 | | 8/2009 |
| JP | 2009-181077 | | 8/2009 |
| JP | 2009-276438 | | 11/2009 |

* cited by examiner

IMAGE FORMATION APPARATUS

CROSS-REFERENCE TO RELATED APPLICATION

This application claims priority under 35 U.S.C. §119 from Japanese Patent Application No. 2010-110485 filed on May 12, 2010. The entire subject matter of the application is incorporated herein by reference.

BACKGROUND

1. Technical Field

Aspects of the present invention relate to a direct tandem type image formation apparatus.

2. Related Art

Conventionally, there has been known an image formation apparatus such as one disclosed in United States Provisional Publication No. 2009/190978 A1. Such a conventional image formation apparatus is provided with a drawer casing, which accommodates a plurality of process units and is configured to be inserted in and/or drawn from a housing of the image formation apparatus, through an opening formed on the housing. In such an apparatus, a cover which can open/close the opening is provided, and a guide is provided to the cover. The guide is for guiding a printing sheet transferred from a pair of register rollers to an endless belt for feeding the printing sheet inside the image formation apparatus.

SUMMARY

According to the conventional structure as above, since the guide is for guiding the printing sheet fed from the register rollers to the endless belt, accuracy of relative positions between the guide and the photoconductive drum, and accuracy of relative positions between the guide and the belt unit should be high. Otherwise, the positioning of the printing sheet becomes inaccurate, which causes a bad effect on image quality.

According to the publication, since the guide is provided on the cover which is movable, it is difficult to obtain high accuracy in relative positions between the guide and the photoconductive drum, and between the guide and the belt unit.

In order to improve the positional accuracy, a mechanism that enables accurate positioning of the movable cover with respect to the housing may be required. However, employment of such a mechanism may increase a manufacturing cost of the image formation apparatus.

According to aspects of the invention, there is provided an image formation apparatus configured to form an image on a printing sheet in accordance with an electrophotographic image formation method, which includes a belt unit including a pair of belt rollers and an endless belt wound around the pair of belt rollers, the endless belt including a bridging surface bridging between the pair of rollers, the printing sheet being fed between the photoconductive drum and the bridging surface of the endless belt facing the photoconductive drum, a plurality of process units each having a photoconductive drum arranged to face a bridging surface of the endless belt and bear developing agent corresponding to an image, a drawer casing configured to accommodate the plurality of process units, the drawer casing being movable along a feed path which is parallel with the bridging surface of the endless belt so that the drawer case casing is insertable in and/or drawable from a main body of the image formation apparatus, an openable cover which is provided to cover an opening formed on one end face at one end in a drawing direction of the drawer casing, the openable cover being movable between an open position where the openable cover does not cover the opening and a close position where the openable cover covers the opening, a sheet tray arranged on an side opposite to the drawer casing with respect an imaginary plane that includes the bridging surface, the sheet to be fed by the belt unit being mounted on the sheet tray, a pair of rollers arranged on a sheet tray side with respect to the movable path and configured to feed the sheet fed from the sheet tray to the belt unit, a first guide provided to the drawer casing and configured to guide the sheet fed by the pair of rollers toward the bridging surface, and a second guide provided opposite to the first guide with a predetermined clearance therebetween, the second guide forming a sheet feed path in association with the first guide.

According to aspects of the invention, there is provided an image formation apparatus configured to form an image on a sheet in accordance with an electrophotographic image formation method, which includes a main body including a housing formed with an opening, and an openable cover which is movable between an open position where the openable cover uncovers the opening and a close position where the openable cover covers the opening, a plurality of process units each having a photoconductive drum bearing developing agent, a belt unit including a pair of belt rollers and an endless belt, the endless belt including a stained bridging surface tensioning between the pair of rollers and facing the photoconductive drum, the sheet being fed between the photoconductive drum and the strained bridging surface, a drawer casing accommodating the plurality of process units, the drawer casing being drawable from the main body, through the opening, along a moving path which is parallel with the strained bridging surface, a sheet tray arranged at a position opposite to the drawer casing with respect the belt unit, the sheets to be fed to the belt unit being mounted on the sheet tray, a first guide provided to the drawer casing, a second guide provided to face the first guide with a predetermined clearance therebetween, and a pair of rollers configured to feed the sheet from the sheet tray toward the first guide and the second guide, the pair of rollers being arranged in a space sandwiched between the strained bridging surface and the sheet tray.

BRIEF DESCRIPTION OF THE ACCOMPANYING DRAWINGS

DETAILED DESCRIPTION

Figure 1:
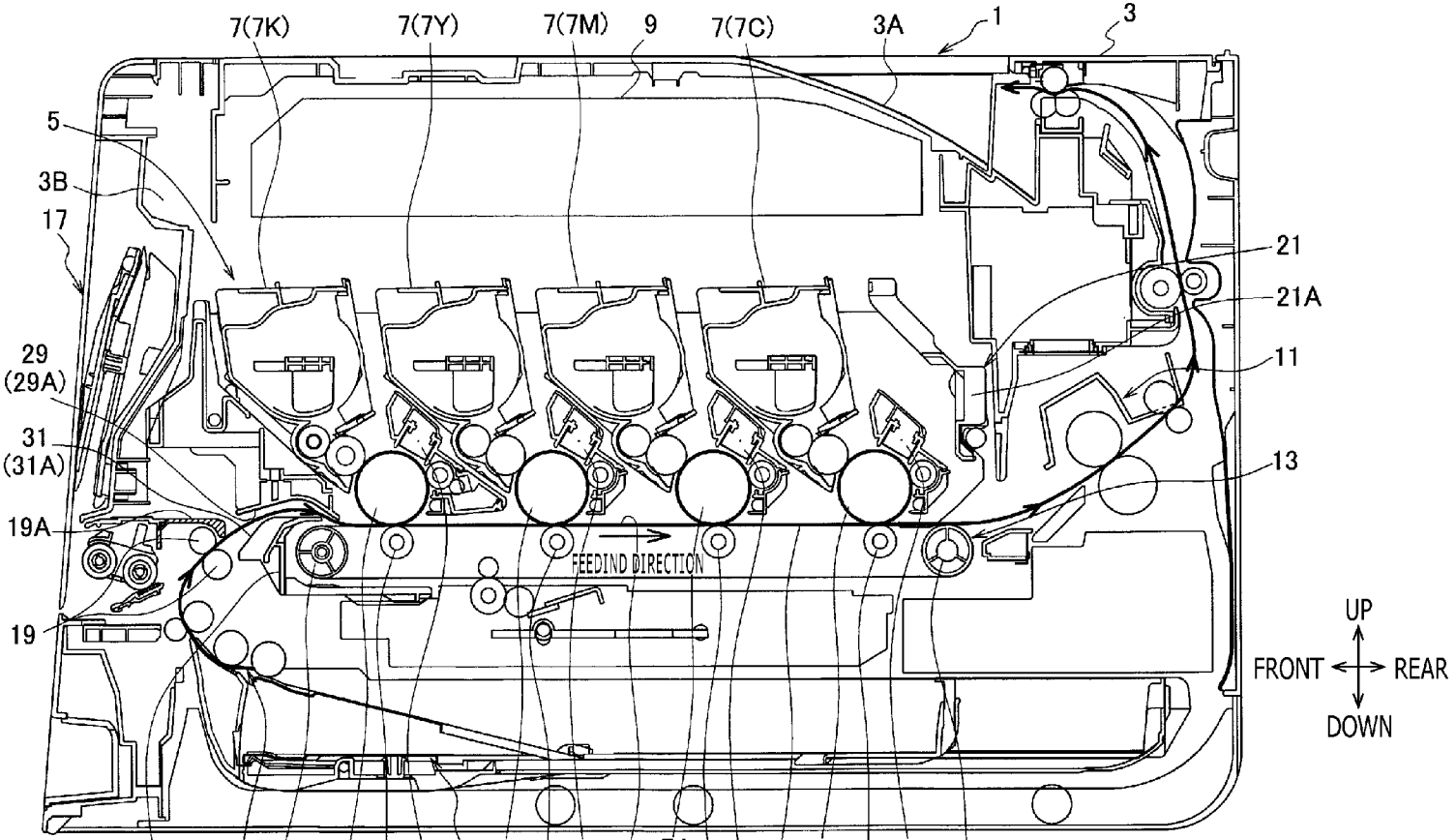
FIG. 1 is a cross-sectional view of an image formation apparatus according to an embodiment of the invention.

Hereinafter, an exemplary embodiment according to aspects of the present invention will be described with reference to the accompany drawings.

In an image formation apparatus 1 (FIG. 1), an image formation unit 5 is accommodated. The image formation unit 5 is for forming an image on a printing sheet such as a recording sheet or an OHP sheet by transferring developer agent in accordance with an electrophotographic image formation method. The image formation unit 5 is provided with, as is well known, a plurality of process units 7 (7K, 7Y, 7M and 7C), an exposure unit 9 and a fixer unit 11.

The image formation unit 1 according to the embodiment is a so-called direct tandem type color image formation apparatus, and a plurality of process units (four process units) 7 corresponding to four color components are arranged along a sheet feed direction. Specifically, the four process units 7 are process units 7K, 7Y, 7M and 7C for printing black, yellow, magenta and cyan images, respectively, which are arranged in this order from the upstream side to the downstream side in the sheet feed direction which is indicated by arrow FD in FIG. 1.

In each of the drawings, directions (i.e., up and down directions, right and left directions, and front and rear directions, sheet feed direction, etc.) are indicated for the purpose of explanation. In the following description, the indicated directions in each drawing are referred to for explaining directions.

It should be noted that the four process units 7K, 7Y, 7M and 7C have substantially the same structures, and only the color of the developing agents are different. Therefore, in the following description, the process unit 7 will be described. The process unit 7 represents any one of the four process units 7K, 7Y, 7M and 7C.

The process unit 7 has a photoconductive drum 7A, and a charger 7B that charges the outer circumferential of the photoconductive drum 7A. The charged photoconductive drum 7A is exposed to light representing an image which is emitted by the exposure unit 9 so that an electrostatic latent image is formed on the outer circumferential of the photoconductive drum 7A. Then, by supplying charged toner to the photoconductive drum 7A, the toner is selectively adhered on the circumferential surface of the photoconductive drum 7A in accordance with the latent image so that a toner image is formed thereon.

At a position opposite to the photoconductive drum 7A with respect to a strained bridging surface 13H of a transfer belt 13A, which functions also as a sheet feed belt, a transfer roller 15 is provided (see FIG. 1). It should be noted that there are four photoconductive drums 7 and four corresponding transfer rollers 15, but in the description, one transfer roller 15 corresponding to one process unit 7 will be described for brevity. For the (image) transferring operation, the transfer roller 15 is applied with a voltage necessary for transferring the toner image from the photoconductive drum 7A to the printing sheet.

The transfer belt 13A is an endless belt wound between a driving roller 13B and a driven roller 13C. Both end portions (right and left end portions) of each of the driving roller 13B and driven roller 13C are supported by right and left belt frames 13D (see FIG. 2) which extend in a bridging direction (i.e., front and rear direction).

The strained bridging surface 13H is defined as a surface of a portion of the transfer belt 13A, which portion is a planar portion that bridges between the driving roller 13B and the driven roller 13C and faces the photoconductive drum 7A with a certain tension being applied (i.e., with being strained). The bridging direction is defined as a direction parallel with a direction directed from the driving roller 13B to the driven roller 13C.

The plurality of the photoconductive drums 7A are arranged above the strained bridging portion 13H to face the strained bridging portion 13H, along the sheet feed direction. Each of the photoconductive drums 7A are oriented such that a rotational axis is perpendicular to the sheet feed direction. The toner image carried on the circumferential surface of the photoconductive drum 7A is transferred on the sheet that is fed by the transfer belt 13A.

When the toner image is transferred onto the sheet fed by the transfer belt 13A, the printing sheet is fed toward a fixing unit 11 where heat is applied to the toner image so that the toner image is fused and fixed onto the sheet. Thereafter, the printing sheet is moved upward and discharged onto a discharge tray 3A which is formed on an upper surface of the housing 3.

On one side of each belt frame 13D (on a front side in this embodiment), a bridge frame 13E that extends between the pair of belt frames 13D is provided. As above, the belt unit 13 includes the bridge frame 13E, the transfer belt 13, the driving roller 13B, the driven roller 13C and the belt frames 13D.

Figure 3:
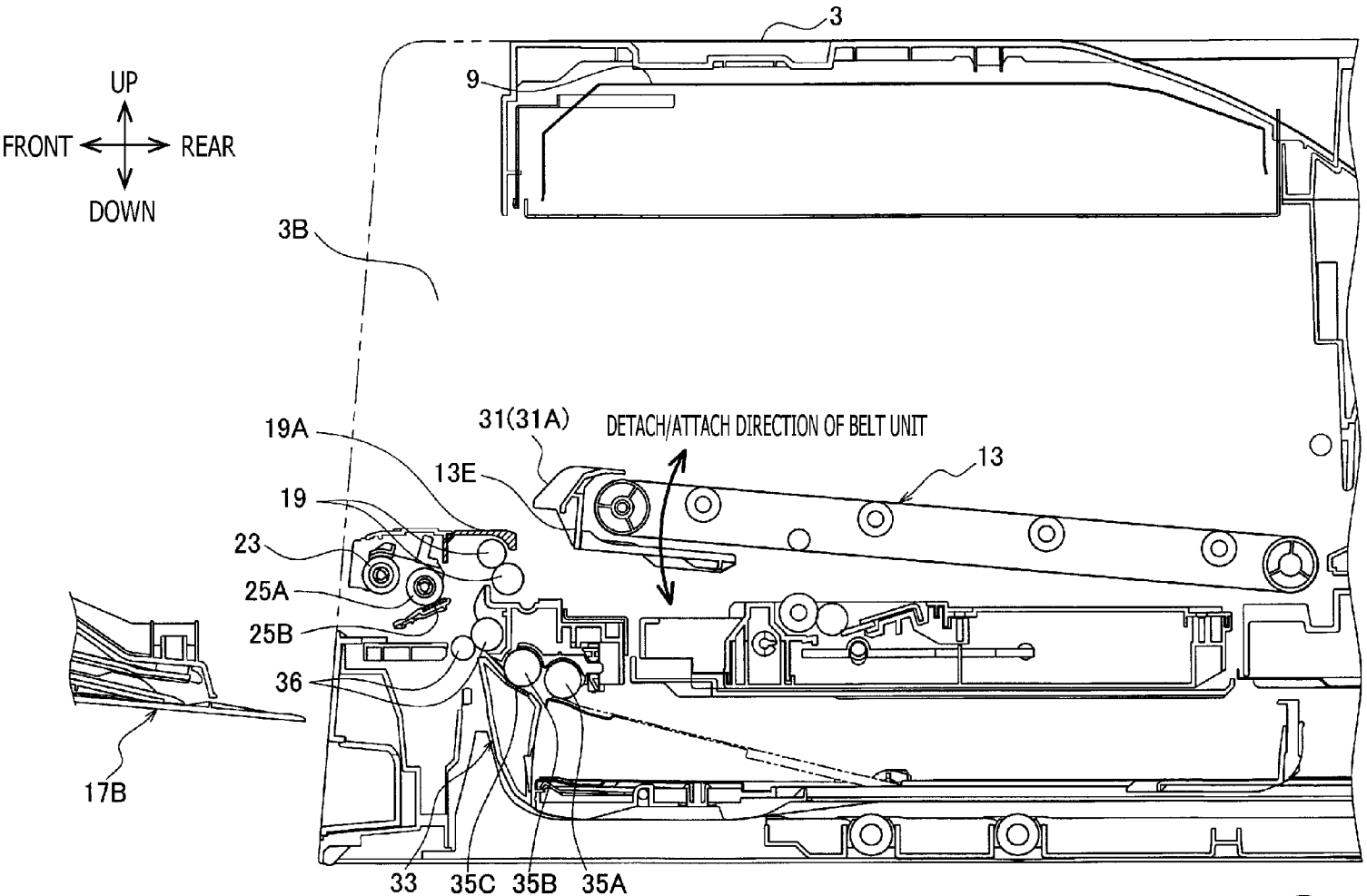
FIG. 3 is a cross-sectional view showing attachment/detachment of the belt unit shown in FIG. 2, according to the embodiment.

The belt unit 13 is detachably attached to a main body of the image formation apparatus 1 (see FIG. 3). The main body includes the housing 3 and a pair of support frames which will be described later. In order to detach the belt unit 13 from the main body, it is necessary to detach a drawer casing 21A that accommodates the process unit 7 beforehand. The image formation unit 5 including the process units 7 accommodated in the drawer casing 21A, the belt unit 13, the sheet tray 33, the feeder mechanism 35, and the register rollers 19 are supported by the common frames (support frames), which are accommodated in the housing 3.

Figure 2:
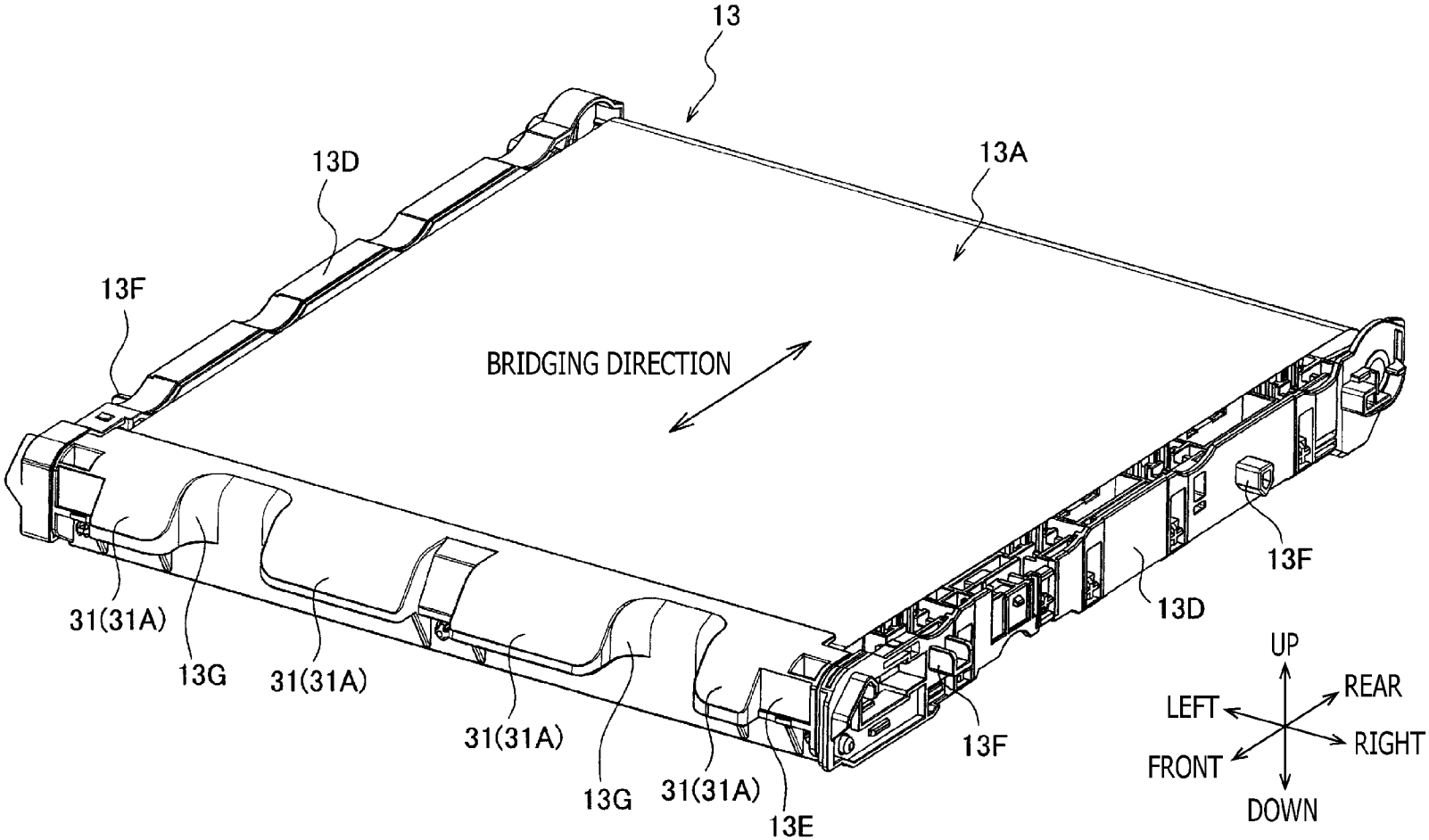
FIG. 2 is a perspective view of a belt unit of the image formation apparatus shown in FIG. 1.

The pair of belt frames 13D is provided with positioning protrusions 13F (see FIG. 2). The positioning protrusions 13F contact protrusions provided to the main body (supporting frames), not shown, so that the position of the belt unit 13 with respect to the main body is adjusted.

The four process units 7K, 7Y, 7M and 7C are arranged inside the drawer casing 21A as shown in FIG. 1. The drawer casing 21A has a substantially rectangular outlined shape viewed from the above (i.e., in a plan view) and has a pair of side walls, front wall and a rear wall. The drawer casing 21A has an opened upper face, and accommodates the four processing units 7K, 7Y, 7M and 7C, which are arranged in the sheet feed direction FD.

The photoconductive drum 7A and the charger 7B of each process unit 7 extend in a direction perpendicular to the sheet feed direction, which direction is parallel with the front and rear walls of the drawer casing 21A.

The drawer casing 21A is attached to the main body with being guided by a rail structure provided to each of the pair of frames so that it is movable in a direction where the sheet is fed by the transfer belt 13A, which is substantially parallel with the direction in which the four process units 7K, 7Y, 7M and 7C are arranged.

The drawer casing 21A is supported at a lowered position at which the photoconductive drum 7A contacts the transfer belt 13A at a position opposite to the transfer roller 15 with the transfer belt 13A located therebetween, when the drawer casing 21A is located at an attached position inside the main body. The rail member has an inclined guiding surface which is configured such that, when a pulling force to move the drawer casing 21A toward outside of the main body is applied to the drawer casing 21A at the attached position, the drawer casing 21A is lifted to an upper front direction so that the photoconductive drum 7A is moved up away from the transfer belt 13A. The rail member also has a linear guiding surface which is configured to guide the drawer casing 21A, with the photoconductive drum 7A being lifted and separated from the transfer belt 13A, in a direction substantially parallel with an imaginary plane S1 which includes the strained bridging surface 13H.

With the above configuration, a moving path DL of the bottom end of the drawer casing 21A (hereinafter, simply referred to as a moving path DL of the drawer casing 21A) extends substantially parallel with the imaginary plane S1 with a predetermined distance from the imaginary plane S1. The distance between the moving path DL and the imaginary plane S1 is sufficient if the bottom end of the photoconductive drum 7A does not interfere with a protection cover 19A and a second guide 31 (described later) when the drawer casing 21A is pulled out from the main body. According to the embodiment, the minimum distance may be, for example, within a range between 3 mm to 10 mm.

By opening a front cover 17 provided at the front face of the housing 3, the drawer casing 21A can be drawn through the front opening 3B of the housing 3. The position of the drawer casing 21A when it is fully drawn from the housing 3 will be referred to as a drawn position. When the drawer casing 21A is located at the drawn position, the four process units 7 are located outside the housing 3. Therefore, if one or more of the processing units 7 run out of the toner, a user can refill the toner. Further, the user can remove the drawer casing 21A for dealing with a sheet jam, or exchanging the belt unit 13 or a belt cleaning unit. The user can attach the drawer casing 21A easily by pushing the same, from the drawn position, rearward.

As described above, according to the embodiment, it is possible to insert/remove the four process units 7K, 7Y, 7M and 7C unitarily with respect to the main body. In the following description, the four process units 7K, 7Y, 7M and 7C and other units accommodated in or attached to the drawer casing 21A will be generally referred to as a drawer unit 21.

According to the embodiment, the photoconductive drum(s) 7A and the charger(s) 7B are secured to the drawer casing 21A, while container unit(s) containing the toner and cartridge(s) 7D provided with developing roller(s) for supplying the toner to the photoconductive drum(s) 7A are detachably attached to the process units 7. Therefore, simply by exchanging the cartridge units 7D, the toner can be refilled.

It should be noted that the above-described configuration is an exemplary one and can be modified in various ways. For example, each process unit 7 may be configured such that the developing unit is integrally secured to the drawer casing 21A with only the toner container remained detachable. Alternatively, the process unit 7 including the photoconductive drum 7A may be configured to be detachable from the drawer casing 21A.

Figure 6:
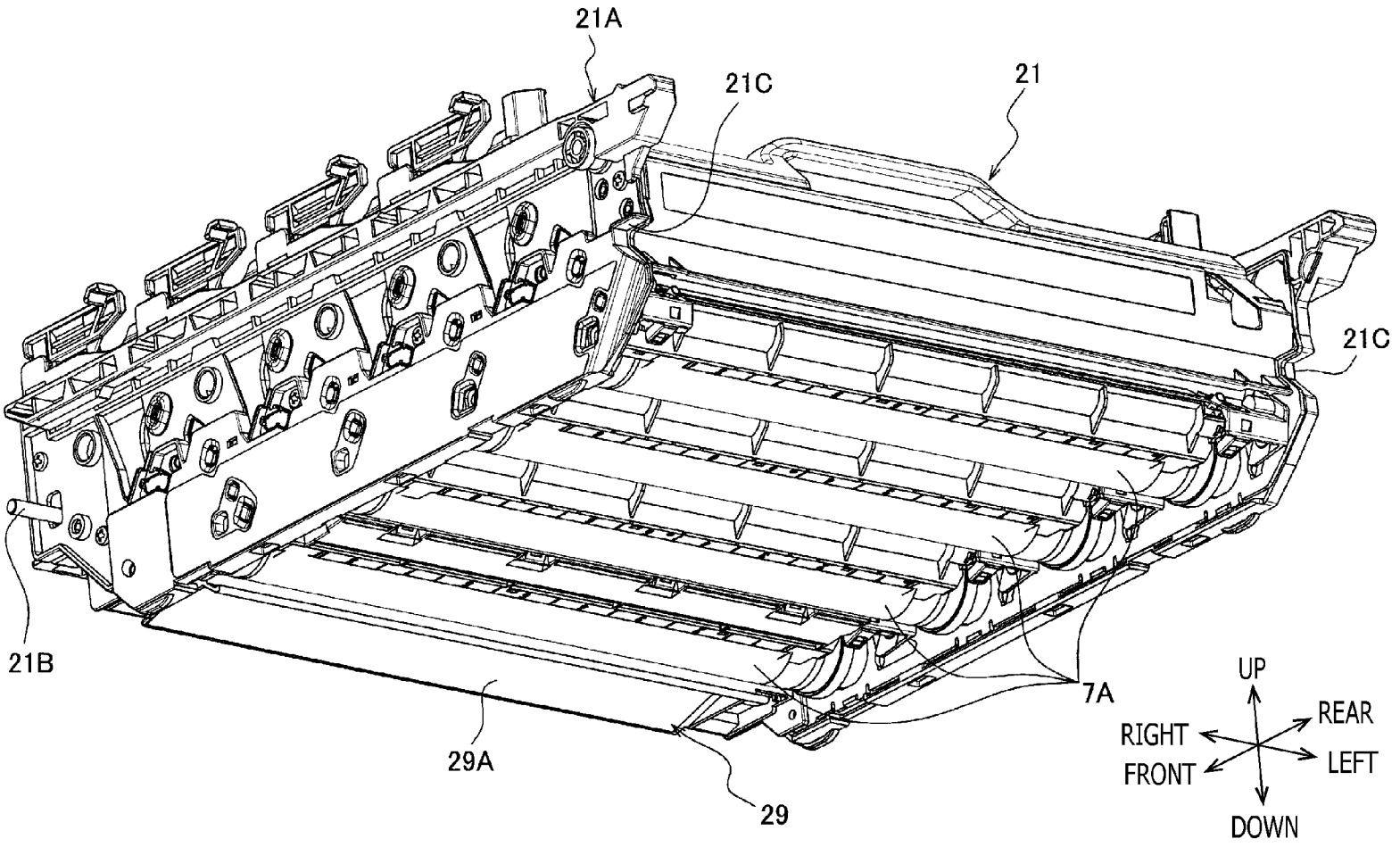
FIG. 6 is a perspective view, viewing from the bottom, of the drawer casing according to the embodiment.

The drawer casing 21A has position adjustors 21B and 21C provided at both ends in the drawing/inserting direction thereof (see FIG. 6). When the drawer casing 21A is inserted and attached to the main body (i.e., body frame), the position adjustors 21B and 21C are abut against contact portions provided to the main body, respectively, so that the position of the drawer casing 21A is adjusted. When the drawer casing 21A is located to its coupled position, the photoconductive drum 7A and the transfer roller 15 face each other with the transfer belt 13A located therebetween.

Figure 4:
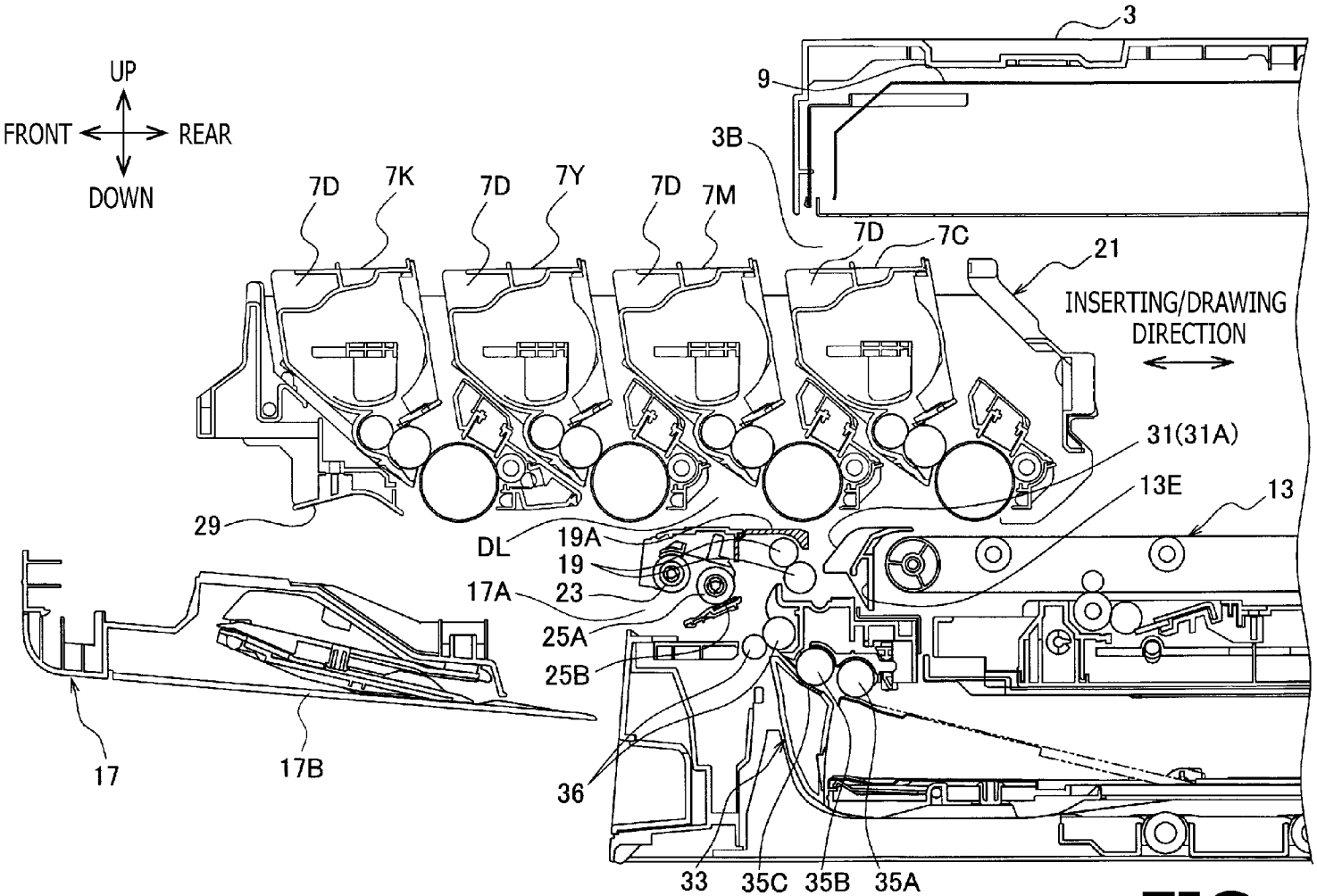
FIG. 4 is a cross-sectional view showing insertion/drawing of a drawer casing according to the embodiment.
Figure 5:
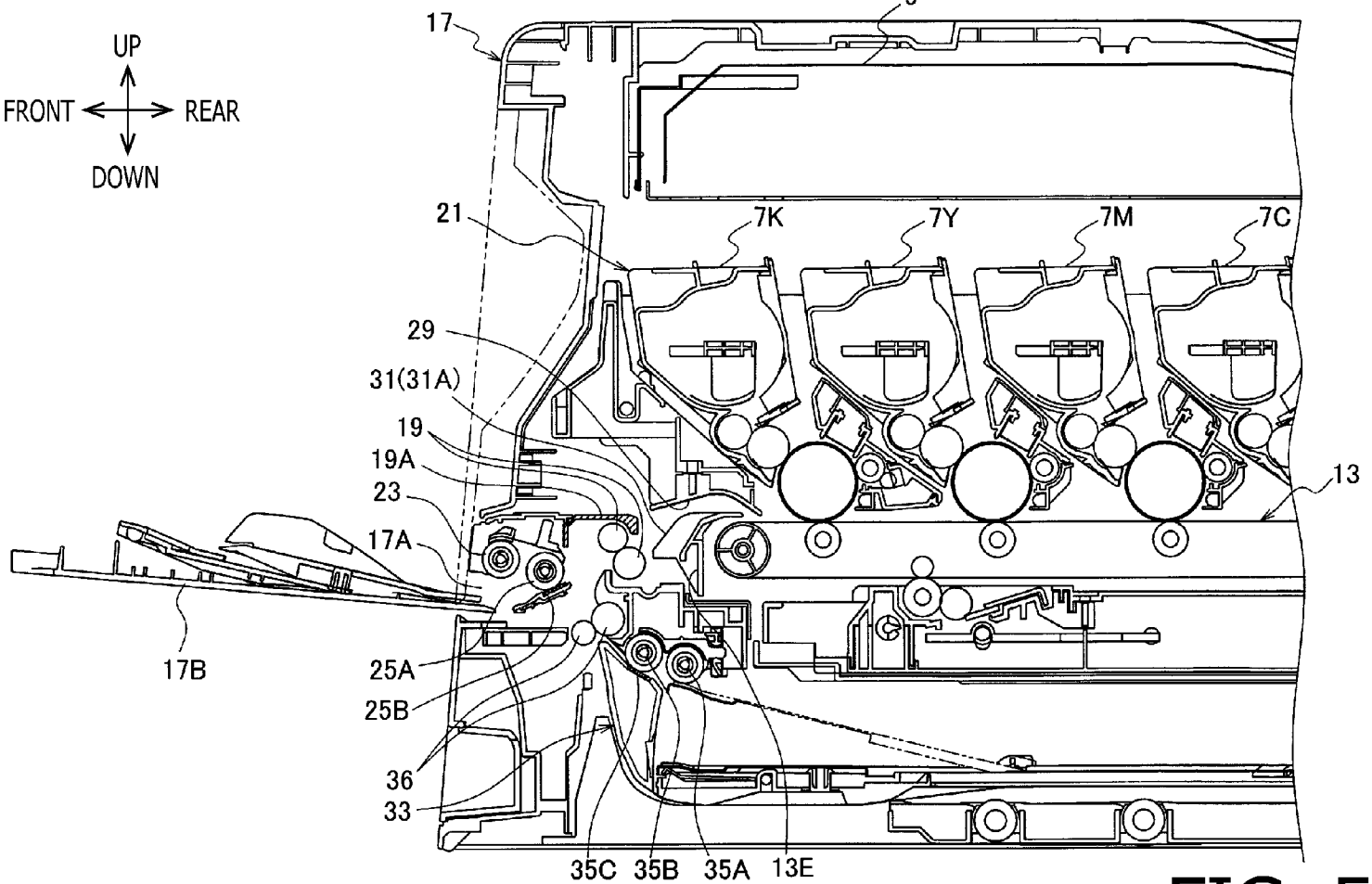
FIG. 5 is a cross-sectional view showing a state where a cover tray is opened, according to the embodiment.

On a front face of the main body, the opening 3B and the front cover 17 which is rockable between an open position where the front cover 17 uncovers the opening 3B and a close position where the front cover 17 covers the opening 3B are provided (see FIGS. 1, 3 and 4). To the front cover 17, a cover tray 17B is formed so that it faces a sheet supply opening 17A. The cover tray 17B serves as a multi-purpose sheet supply tray (hereinafter, referred to as an MP tray).

The sheet supply opening 17A is formed on the front face of the housing 3, which is on a front side with respect to the register roller 19. Thus, the sheet supply opening 17A serves as a sheet supply opening for the MP tray. The sheet is supplied to the belt unit 13 in a substantially flat state. The cover tray 17B is secured to the front cover 17 and configured to be rockable so that the sheet supply opening 17A can be opened/closed with the front cover 17 covering the opening 3B. As described above, when the sheet supply opening 17A is opened, the cover tray 17B serves as the MP tray.

In the vicinity of the sheet supply opening 17A, between the opening 3B and the belt unit 13, provided are a pick-up roller 23 which sends the uppermost sheet mounted on the cover tray 17B to the pair of register rollers 19, and separation roller 25A and separation pad 25B which separate a plurality of sheets so that the sheets is fed one by one toward the register roller 19.

According to the embodiment, the register roller 19 has a function to adjust a timing when the sheet is transferred to the belt unit 13, and a function to correct a skew (i.e. an obliquely fed condition) of the sheet transferred to the belt unit 13. It is noted that the register roller 19 needs not have both functions, and may have only one function. Alternatively, instead of the register roller 19, another roller, which simply feeds a sheet toward the belt unit 13 but does not have the above functions, may be provided.

In the main body, on a side opposite to the drawer casing 21A with respect to the imaginary plane S1 that includes the strained bridging surface 13H (i.e., below the imaginary plane S1), a sheet tray 33 on which sheets to be fed toward the belt unit 13 is provided as shown in FIG. 1. The sheet tray 33 may be configured to be drawable in a direction parallel with a direction where the drawer casing 21A is drawn. Optionally, the sheet tray 33 may be slidable and removable from the housing 3.

The pair of register rollers 19 is arranged on the sheet tray side with respect to the moving path D of the drawer casing 21A. That is, the pair of register rollers 19 is arranged substantially at the same level (height) as the imaginary plane S1 or lower than the moving path D of the drawer casing 21A.

On an upper side of the pair of register rollers 19, that is, on the moving path D side, a protection cover 19A for covering the pair of register rollers 19 is secured to the main body. The protection cover 19A is arranged such that a surface on the moving path D side of the protection cover 19A (i.e., an upper surface of the protection cover 19) is lower than the moving path DL (see FIG. 4).

Figure 7:
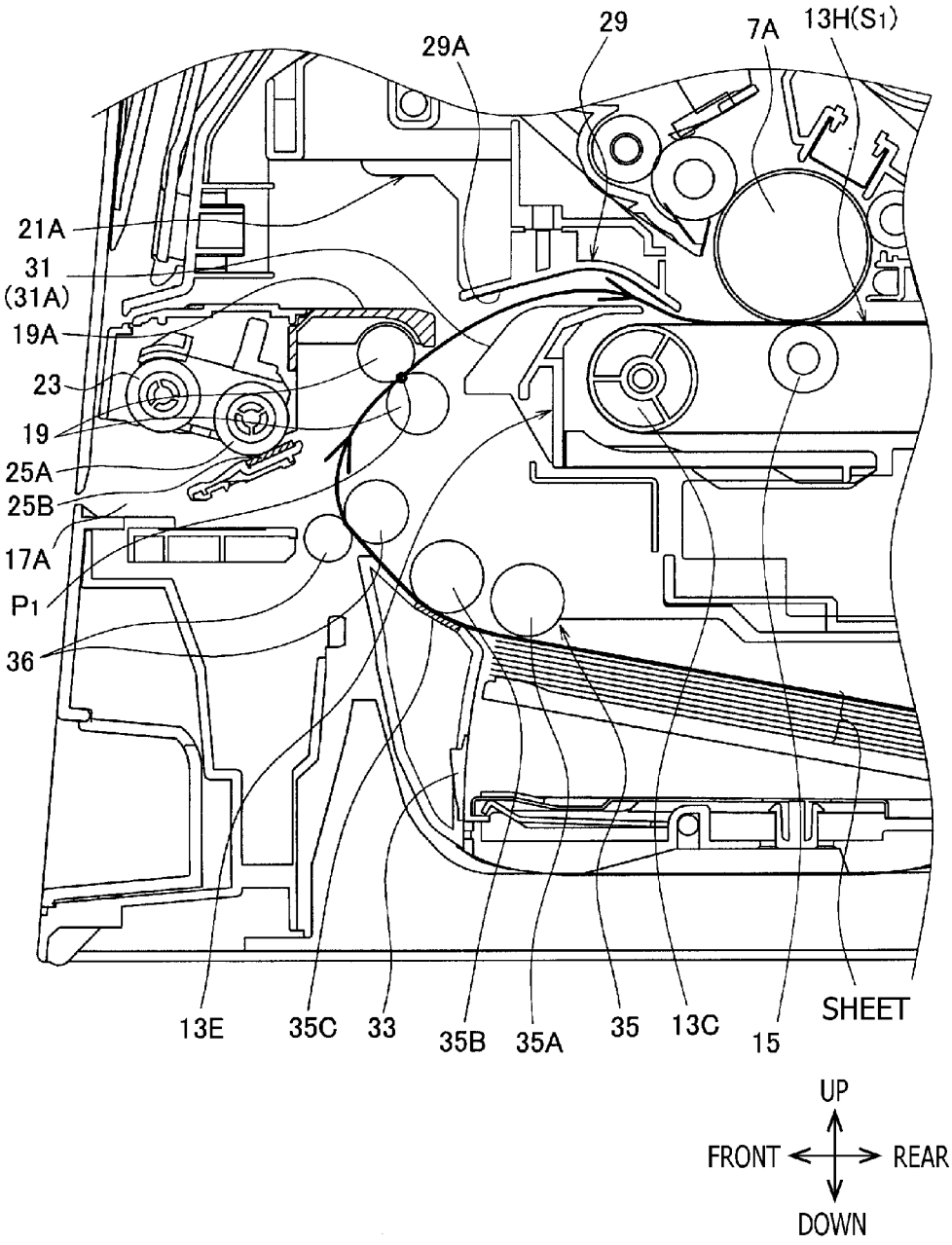
FIG. 7 is an enlarged cross-sectional view showing a portion around a first guide of the image formation apparatus according to the embodiment.

Further, on the register roller side with respect to the drawer casing 21A and on the belt unit side (i.e., on a lower end side in the embodiment), a first guide 29 that guides the sheets fed by the pair of register rollers 19 toward the strained bridging surface 13H is provided as shown in FIG. 7. The first guide 29 is formed on the lower end of the front wall of the drawer casing 21A as shown in FIG. 6.

On a bridge frame 13E of the belt unit 13, a second guide 31 that defines, in association with the first guide 29, a sheet feed path is provided. The second guide 31 and the first guide 29 are arranged to face each other with a predetermined distance therebetween.

The second guide 31 has a pentroof-like inclined portion 31A (see FIG. 2) that protrudes from the belt unit 13 toward the pair of register roller 19, and inclines downward with respect to the imaginary plane S1 such that the register roller side end of the inclined portion 31A is lower than the other side.

The first guide 29 is arranged to cover the inclined portions 31A (i.e., the second guide 31) entirely from the above. Specifically, the first guide 29 extends to cover a range from a portion corresponding to an upside of the inclined portions 31A to a portion corresponding to the strained bridging portion 31H of the transfer belt 13A. The guide surface 29A of the first guide 29 is curved such that the guide surface 29A has an upwardly convex shape when viewed from a direction perpendicular to the sheet feed direction and to a direction of the thickness of the first guide 29.

With the above configuration, the sheet is initially fed in an obliquely upward direction from the nip P1 between the pair of register rollers 19 to proceed above the imaginary plane S1. Then, by the first guide 29, the feeding direction is changed downward and the sheet is directed to the strained bridging portion 13H at an acute angle (i.e., the sheet and the surface of the strained bridging portion 13H form an angle less than 90 degrees).

The bridge frame 13E has a gripper portion 13G which is gripped by a user when the belt unit 13 is detached from the main body. As shown in FIG. 2, the gripper portion 13G is formed as if a part of the pentroof-like inclined portion 31A is cut out. It should be noted that the gripper portion 13G does not have any structures which protrude from the bridge frame 13E.

Figure 8:
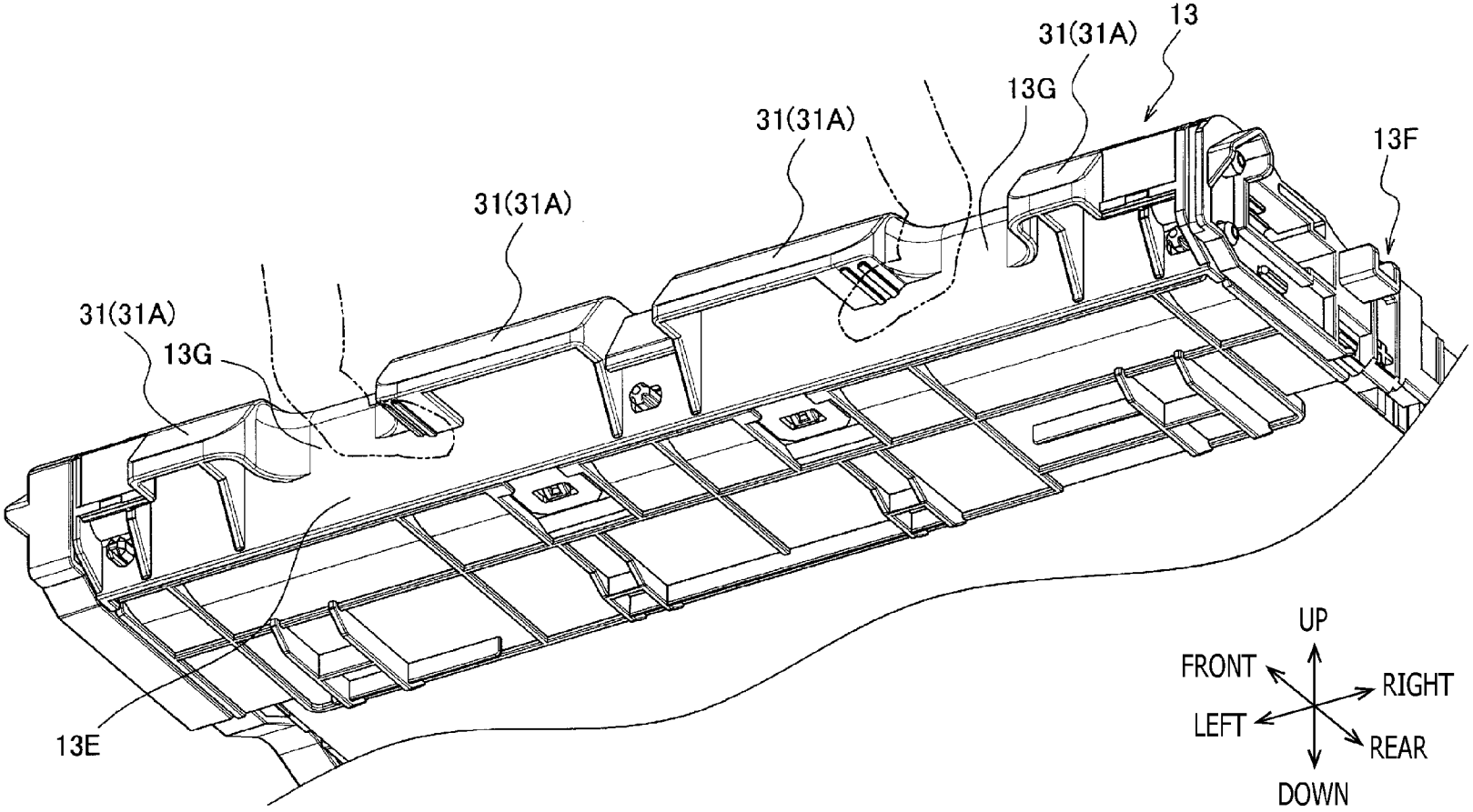
FIG. 8 is a perspective view, viewing from the bottom, of the belt unit according to the embodiment.

When the user grips the gripper portion 13G, the user may insert fingers from upper side to lower side through the cut-out-like portions of the gripper portion 13G, and hook the fingers onto the lower surfaces of the pentroof-like inclined portion 31A as shown by two-dotted line in FIG. 8.

Below the belt unit 3113, the sheet feed tray 33 is detachably attached as shown in FIG. 1. Sheets to be fed toward the image formation unit 5 and transfer belt 13A are mounted on the sheet feed tray 33. With a feeder mechanism 35, the sheets mounted on the sheet feed tray 33 is fed one by one toward the pair of register rollers 19.

The feeder mechanism 35 includes, as shown in FIG. 7, a pickup roller 35A configured to feed the sheets stacked on the sheet feed tray 33 to the pair of register rollers 19, and a separation roller 35B and a separation pad 35C configured to separate a plurality of sheets fed from the pickup roller 35A so that one sheet is fed to the pair of register rollers 19 at a time.

On the downstream side, in the sheet feed direction, of the separation roller 35B, there are provided a pair of feed rollers 36 configured to feed the sheet, which has been separated by the separation roller 35B and the separation pad 35C, to the pair of register rollers 19. The feed rollers 36, the separation roller 35B and the pickup roller 35A are accommodated, similarly to the pickup roller 23 and the register rollers 19, in the housing 3 at a location close to the front cover 17 and below the imaginary plane 51.

According to the embodiment, the first guide 29 and the photoconductive drums 7A are accommodated in the same member (i.e., in the drawer casing 21A), accuracy of the positional relationship between the first guide 29 and each of the photoconductive drums 7A can be made higher in comparison with a case where the first guide is provided on a front cover that is different from the drawer casing.

The drawer casing 21A, which is provided with the first guide 29, and the belt unit 13 are supported by the same frames, positional relationship therebetween can be made more accurate in comparison with a case where the first guide is provided to a front cover which is movable with respect to the frame supporting the belt unit.

According to the embodiment, the sheet fed from the register rollers 19 is directed to a predetermined position on the belt unit 13 (i.e., the transfer belt 13A) as designed. Therefore, with the above configuration, deterioration of the quality of the image formed on the sheet can be suppressed.

Still further, according to the embodiment, the pair of register rollers 19 and the belt unit 13 are supported by the common frame inside the image formation apparatus. Therefore, positional relationship among the pair of register rollers 19 and the belt unit 13 can easily be made accurate.

Further, as the pair of register rollers 19 are is provided inside the image formation apparatus, a mechanism that transmits a rotational force to the pair of register rollers 19 can be made simple in comparison with a case where the pair of register rollers are is provided to the front cover.

According to the embodiment, it is unnecessary to locate the front cover accurately with respect to the main body when the front cover is closed. Therefore, the front cover can be configured to have a relatively simple structure.

According to the embodiment, the pair of register rollers are arranged on the sheet feed tray side with respect to the moving path DL of the drawer casing 21A. Therefore, the drawer casing 21A and the pair of register rollers do not interfere with each other when the drawer casing 21A is drawn from the main body or inserted in the main body. That is, no particular structures for avoiding the interference between the drawer casing and register rollers are required. Therefore, manufacturing cost can be suppressed since the front cover can be made to have a simple structure, without detracting the operability of insertion/removal movement of the drawer casing 21A.

According to the embodiment, the second guide 31 is provided to the belt unit 13. Therefore, relative positional accuracy between the second guide 31 and the transfer belt 13A of the belt unit 13 can be made higher. With this configuration, the sheet fed along the second guide 31 can be guided to the transfer belt 13A accurately.

According to the embodiment, the drawer casing 21A is arranged above the imaginary plane S1 and the sheet tray 33 is arranged below the imaginary plane S1. The second guide 31 is provided with the inclined portion 31A which extends from the strained bridging surface 13H of the belt unit 13 to the pair of register rollers 19, and is inclined with respect to the imaginary plane S1 such that the height of the inclined portion 31A is lower at a position closer to the register rollers 19. The first guide 29 extends within a range from a position above the inclined portion 31A to a position corresponding to the transfer belt 13A.

According to the above configuration, a sheet fed from the pair of register rollers 19 toward the image formation unit 5 is guided by the inclined portion 31A and the second guide 31, and is accurately directed onto the transfer belt 13A.

According to the embodiment, the gripper portion 13G is formed to the bridge frame 13E of the belt unit 13 to enable the user to remove the belt unit 13 easily. Therefore, even if the pair of register rollers 19 is provided to the main body, the user can attach/detach the belt unit 13 to/from the image formation apparatus easily.

According to the embodiment, the bridge frame 13E is formed as if a part of the bridge frame 13E has been removed in order to form the gripper portion 13G. With this configuration, no part of the bridge frame 13E protrudes in order to form the gripper portion. Thus, the gripper portion can be formed without causing a bad affect to sheet feeding. The gripper portion thus provided allows a user to exchange the belt unit without touching the endless belt.

According to the embodiment, the cover tray 17B is provided to the front cover 17. Since the pickup roller 23 is provided to the main body, but not to the front cover, the structure of the front cover 17 can be made relatively simple, and manufacturing cost can be suppressed.

According to the embodiment, the pair of register rollers 19, the pickup roller 23 and the pickup roller 35A are provided to the main body, on the front cover side. With this configuration, the pair of register rollers 19, the pickup roller 23 and the pickup roller 35A are arranged relatively closely to each other. Thus, the image formation apparatus 1 can be downsized and the mechanism that supplies rotational force to the rollers.

According to the embodiment, the protection cover 19A is provided, which covers the moving path DL of the drawer casing 21A to the pair of register rollers 19. Since the protection cover 19A is arranged below the moving path DL of the drawer casing 21A, damage of the pair of register rollers 19 as they are struck by the drawer casing 21A when it is drawn can be prevented.

According to the embodiment, the second guide 31 is provided to the belt unit 13 (bridge frame 13E). The invention needs not be limited to such a configuration, and the second guide may be provided to, for example, the main body (i.e., housing).

The invention need not be limited to the configuration described above, and various embodiments can be provided without departing from the scope of the invention.

What is claimed:

1. An image formation apparatus configured to form an image on a printing sheet in accordance with an electrophotographic image formation method, the image formation apparatus comprising:

a belt unit including a pair of belt rollers and an endless belt wound around the pair of belt rollers, the endless belt including a bridging surface bridging between the pair of rollers;

a plurality of process units each having a photoconductive drum arranged to face the bridging surface of the endless belt and bear developing agent corresponding to an image, the photoconductive drum of each process unit and the bridging surface of the endless belt facing the photoconductive drum configured to allow a sheet to be fed therebetween;

a drawer casing configured to accommodate the plurality of process units, the drawer casing being movable along a moving path which is parallel with the bridging surface of the endless belt so that the drawer casing is insertable in and drawable from a main body of the image formation apparatus;

an openable cover which is provided to cover an opening formed on one end face at one end in a moving direction of the drawer casing, the openable cover being movable between an open position where the openable cover does not cover the opening and a close position where the openable cover covers the opening;

a sheet tray arranged on a side opposite to the drawer casing with respect to an imaginary plane that includes the bridging surface, the sheet tray configured to receive the sheet thereon to be fed by the belt unit;

a pair of rollers arranged on a sheet tray side with respect to the moving path and configured to feed the sheet fed from the sheet tray to the belt unit;

a first guide provided on the drawer casing and configured to guide the sheet fed by the pair of rollers toward the bridging surface; and a second guide provided opposite to the first guide with a predetermined clearance therebetween, the second guide forming a sheet feed path in association with the first guide, wherein the surface of the second guide opposing the first guide is substantially parallel with the bridging surface of the endless belt, wherein the belt unit further includes a pair of frames extending in a bridging direction of the endless belt and supporting both ends of each of the pair of belt rollers, wherein the belt unit is detachably attached to the main body, wherein a bridge frame extends between the pair of frames and is provided at end portions, in the bridging direction, of the pair of frames, wherein an inclined portion is formed on the bridge frame, the bridge frame being further provided with a gripper portion which is gripped by a user when the belt unit is removed from the image formation apparatus, wherein the gripper portion is formed to have at least one cutout-like portion of the bridge frame that penetrates completely through the bridge frame in a direction perpendicular to the bridging surface of the endless belt and opposes the first guide, wherein each cutout-like portion is surrounded on two opposite sides by extensions of the bridge frame such that the extensions are parallel to each other and to the bridge frame, and wherein the gripper portion does not have any portions which protrude from the bridge frame toward the first guide.

2. The image formation apparatus according to claim 1, wherein the second guide is provided on the belt unit.

3. The image formation apparatus according to claim 1, wherein the drawer casing is arranged on an upper side with respect to the imaginary plane, wherein the sheet tray is arranged on a lower side with respect to the imaginary plane, wherein the second guide is formed with the inclined portion which extends from the bridging surface of the belt unit toward the pair of rollers, the inclined portion being inclined with respect to the imaginary plane such that a position of the inclined portion closer to the pair of rollers is lower than a position of the inclined portion closer to the bridging surface of the endless belt, and wherein the first guide extends from a position opposite to an upper portion of the inclined portion to a position opposite to the endless belt.

4. The image formation apparatus according to claim 3, wherein the main body is provided with a protection cover configured to cover the pair of rollers from a moving path side of the image formation apparatus, the protection cover being located lower than the moving path of the drawer casing.

5. The image formation apparatus according to claim 1, wherein the openable cover is provided with a sheet supply opening through which the sheet is fed to the belt unit and a cover tray configured to open/close the sheet supply opening, the cover tray being configured to receive the sheet thereon when opened, and wherein the main body is provided with a first feed roller configured to feed the sheet when on the cover tray toward the pair of rollers.

6. The image formation apparatus according to claim 5, wherein the sheet tray is detachably attached to the main body, wherein the main body is provided with a second feed roller configured to feed the sheet when the sheet is on the sheet tray toward the pair of rollers, and wherein the pair of rollers, the first feed roller and the second feed roller are provided on an openable cover side of the image formation apparatus.

7. An image formation apparatus configured to form an image on a sheet in accordance with an electrophotographic image formation method, comprising:

a main body including a housing formed with an opening, and an openable cover which is movable between an open position where the openable cover uncovers the opening and a close position where the openable cover covers the opening;

a plurality of process units each having a photoconductive drum configured to bear developing agent;

a belt unit including a pair of belt rollers, an endless belt and a lower guide, the endless belt having a strained bridging surface tensioning between the pair of belt rollers and facing the photoconductive drum, the photoconductive drum of each process unit and the strained bridging surface configured to allow a sheet to be fed therebetween;a drawer casing including an upper guide configured to guide the sheet toward the strained bridging surface of the endless belt, the drawer casing configured to accommodate the plurality of process units, the drawer casing being drawable from the main body, through the opening, along a moving path which is parallel to the strained bridging surface;

a sheet tray arranged at a position opposite to the drawer casing with respect to the belt unit, the sheet tray configured to receive the sheet thereon to be fed to the belt unit; and a pair of rollers configured to feed the sheet from the sheet tray toward the strained bridging surface of the endless belt through a sheet feed path between the upper guide and the lower guide, wherein the belt unit further includes a pair of frames extending in a bridging direction of the endless belt and supporting both ends of each of the pair of belt rollers, wherein a bridge frame extends between the pair of frames and is provided at end portions, in the bridging direction, of the pair of frames, wherein the pair of rollers is arranged in a space below the strained bridging surface and above the sheet tray, wherein the lower guide of the belt unit forms the sheet feed path in association with the upper guide of the drawer casing when the drawer casing is inserted in the main body of the image formation apparatus, wherein a first guide is provided on the drawer casing and configured to guide the sheet fed by the pair of rollers toward the bridging surface, wherein a surface of the lower guide facing the upper guide is flat, wherein an inclined portion is formed on the bridge frame, the bridge frame being further provided with a gripper portion which is gripped by a user when the belt unit is removed from the image formation apparatus, wherein the gripper portion is formed to have at least one cutout-like portion of the bridge frame such that each cutout-like portion penetrates completely through the bridge frame in a direction perpendicular to the bridging surface of the endless belt and opposes the first guide, wherein each cutout-like portion is surrounded on two opposite sides by extensions of the bridge frame such that the extensions are parallel to each other and to the bridge frame, and wherein the gripper portion does not have any portions which protrude from the bridge frame toward the first guide.

8. The image formation apparatus according to claim 7, wherein the drawer casing is arranged at an upper position with respect to the belt unit, wherein the sheet tray is arranged at a lower position with respect to the belt unit, and wherein a part of the lower guide has an inclined portion which extends from the strained bridging surface toward the pair of rollers and inclines such that a position of the inclined portion closer to the pair of rollers is lower than a position of the inclined portion closer to the bridging surface of the endless belt.

9. The image formation apparatus according to claim 8, wherein the belt unit is detachably attached to the main body.

10. The image formation apparatus according to claim 8, wherein the main body is provided with a protection cover which covers the pair of rollers from a moving path side of the image formation apparatus, and wherein the protection cover is arranged at a position lower than the strained bridging surface.

11. The image formation apparatus according to claim 7, wherein the openable cover is provided with a sheet supply opening through which the sheet is supplied to the belt unit, and a cover tray configured to open/close the sheet supply opening, the cover tray being configured to receive the sheet when opened, and wherein the main body is provided with a first feed roller configured to feed the sheet from the cover tray toward the pair of rollers.

12. The image formation apparatus according to claim 11, wherein the sheet tray is detachably attached to the main body, wherein the main body is provided with a second feed roller configured to feed the sheet from the sheet tray toward the pair of rollers, and wherein the pair of rollers, the first feed roller and the second feed roller are arranged on a side close to the openable cover and at positions lower than the strained bridging surface.

13. The image formation apparatus according to claim 7, wherein the cutout-like portions of the inclined portion face the upper guide.

14. The image forming apparatus according to claim 7, wherein the surface of the lower guide facing the upper guide is substantially parallel with the bridging surface of the endless belt.

* * * * *